US005140338A

United States Patent [19]

Schmier et al.

[11] Patent Number: 5,140,338

[45] Date of Patent: Aug. 18, 1992

[54] FREQUENCY SELECTIVE RADOME

[75] Inventors: Robert G. Schmier, Glen Burnie; Eric W. Lucas; James A. Bingham, both of Ellicott City, Md.

[73] Assignee: Westinghouse Electric Corp., Pittsburgh, Pa.

[21] Appl. No.: 740,348

[22] Filed: Aug. 5, 1991

[51] Int. Cl.[5] ..... H21Q 15/02; H21Q 15/24

[52] U.S. Cl. ..... 343/909; 343/700 MS; 343/789

[58] Field of Search ..... 343/700 MS, 769, 789, 343/824, 909

[56] References Cited

U.S. PATENT DOCUMENTS 4,170,013 10/1979 Black ..... 343/700 MS
4,443,802 4/1984 Mayes ..... 343/767
4,623,893 11/1986 Sabban ..... 343/700 MS

*Primary Examiner*—John D. Lee
*Assistant Examiner*—Robert E. Wise
*Attorney, Agent, or Firm*—W. G. Sutcliff

[57] ABSTRACT

A freqency selective surface for passing electromagnetic wave energy and the selected frequency band is described. The device includes a conductive apertured substrate having apertures formed therein which are sized and arranged in a predetermined patern. The apertures each form a waveguide segment for electromagnetic energy. In one embodiment dielectric loading material is moldably formed directly into the apertures. In a bipolar arrangement, conductive patches are located on opposite sides of the dielectric coaxially with each waveguide for establishing a capacitive load in accordance with the area of the patches. Dielectric matching material on opposite surfaces of the substrate is employed to match the surface with external media for efficient electromagnetic wave propagation. Other arrangements employ notched patches and air dielectrics.

17 Claims, 5 Drawing Sheets $\epsilon$ = DIELECTRIC CONSTANT

FREQUENCY SELECTIVE RADOME

BACKGROUND OF THE INVENTION

1. Field of the Invention

The invention relates to a frequency selective radome and in particular to a structurally rigid symmetric, electrically conductive substrate structure having symmetric, two pole, iris and loaded circular waveguide elements.

2. Description of the Prior Art

Frequency selective radomes for aircraft constructed from conventional printed circuit RF filter elements, sometimes referred to as frequency selective surfaces (FSS) are known. Fragmentary views of a typical thin screen radome 10 constructed according to the prior art is illustrated in FIGS. 1A-1C. In FIG. 1A some layers have been removed for clarity. In the radome 10, dipole type RF circuit elements 12 are etched on copper foil sheets 14 which are supported into opposite sides of a dielectric substrate 16. The elements 12 include aperture portion 18 and conductive patches 20 which establish a resonant circuit in the space separating the conductive patches. One or more matching dielectric layers 24, 26 are disposed on opposite sides of the device atop the copper foil layers 14 as illustrated.

The arrangement in FIG. 1A is constructed entirely from sheets of dielectric laminated with the metal foil layers 14 and can result in designs with undesirable structural and electrical characteristics. For example, mechanically, the dielectric layers can be relatively thin, are fairly brittle and offer little structural strength. It is difficult to terminate or feather the marginal edge of the dielectric into the mechanical skin of the aircraft. Electrically, the dielectric structure can trap surface waves occurring in the dielectric 16 which results in poor scattering properties. It also can be difficult to scan compensate such devices.

So called "puck" plates which are illustrated in FIGS. 2A-2B are single pole devices employing a relatively thick conductive substrate 32 having circular apertures 34 therein. Rigid ceramic high dielectric constant discs 36 are located in the apertures. The process for manufacturing such devices is extraordinarily time consuming and expensive because the ceramic discs 36 are individually located by hand into in each of the corresponding holes 34. The discs must be installed by hand because a high dielectric constant ceramic is required which cannot be made pourable. One or more dielectric matching layers 38, 40 may be provided as illustrated.

The arrangement illustrated in FIGS. 2A-2B is a single pole device which has relatively poor frequency selectivity. Accordingly, in order to achieve the higher selectivity of a two pole device, a pair of apertured plates 32 are stacked with an interlayer of dielectric material 42 therebetween (FIG. 2C). The devices illustrated in FIGS. 2A-2C are structurally more sound than the thin screen dielectric devices 10 (FIGS. 1A-1C), but are difficult to manufacture and may also be difficult to scan compensate. They also may trap surface waves in the dielectric layer 42.

Devices are fabricated taking into account the desired bandwidth, frequency selectivity, and frequency roll off characteristics. Mechanical parameters including overall geometry such as aperture size and shape, and the electrical properties such as dielectric constants and conductivity of the various layers are all interdependent properties which effect the performance of the final design. These properties must be carefully chosen so that desired performance is achieved.

SUMMARY OF THE INVENTION

The present invention avoids many of the disadvantages and limitations of the described prior arrangements. In particular, the invention comprises a two pole frequency selective surface for passing electromagnetic wave energy in a selected frequency band. The device includes a conductive apertured substrate having structural integrity. The apertures formed in the substrate are sized and arranged in a predetermined pattern, each forming a waveguide segment for electromagnetic energy. A dielectric is located in the apertures. In one embodiment the dielectric is moldable and extends between opposite surfaces of the substrate. The dielectric loads the waveguide in accordance with the dielectric constant thereof. Conductive iris means in the form of conductive patches are located on each side of the dielectric coaxially with each waveguide for capacitively loading the waveguide in accordance with the area of the patch. Dielectric matching material on opposite surfaces of the substrate matches the surface with external media for efficient electromagnetic wave propagation therethrough. Alternative embodiments employ especially shaped irises and dielectrics.

In a particular embodiment of the invention, frequency selectivity is determined mathematically by a matrix of expressions representing the magnetic field integral equation in accordance with the spectral moment method for solving the equation. In the method, the magnetic currents at each boundary are equated in order to establish magnetic and electric field continuity at apertures defined by the ends of the waveguide segment and free space.

DESCRIPTION OF THE PREFERRED EMBODIMENT

Figure 3:
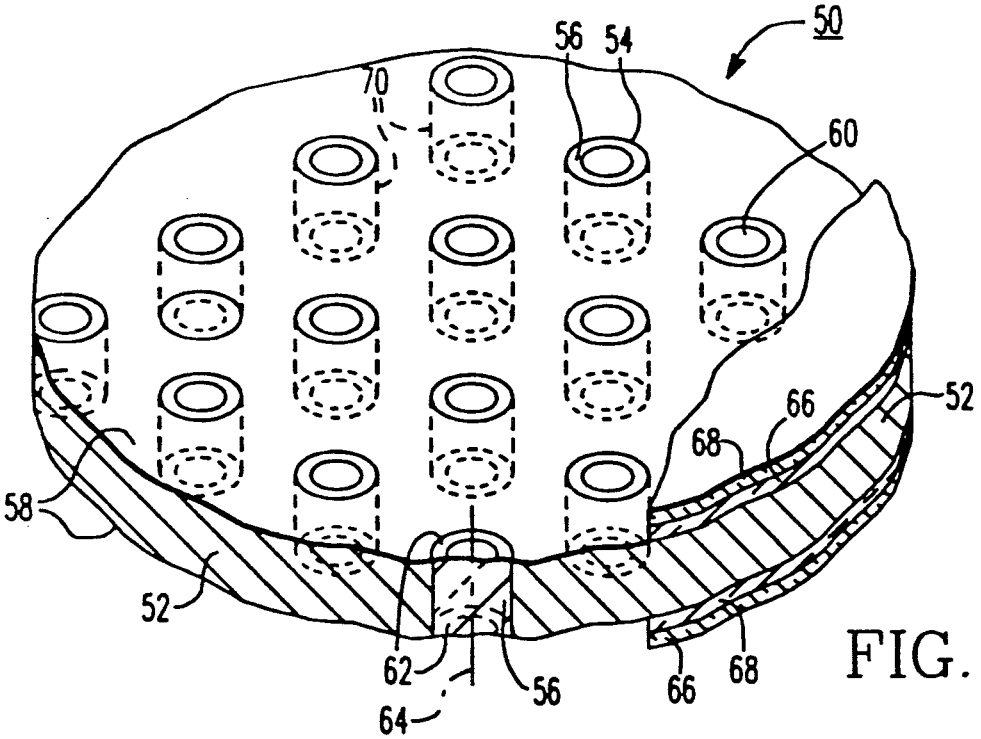
FIG. 3 is a fragmentary portion of a perforated thick screen FSS or artificial puck plate in accordance with the present invention with portions of the dielectric matching layers removed for clarity.
Figure 4:
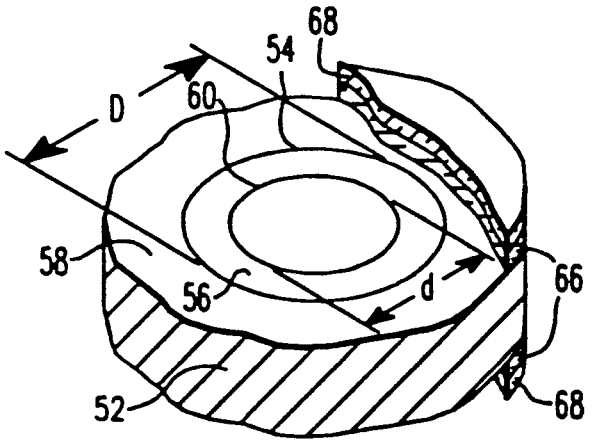
FIG. 4 is, a fragmentary top view of an individual waveguide segment illustrated in FIG. 3.
Figure 5:
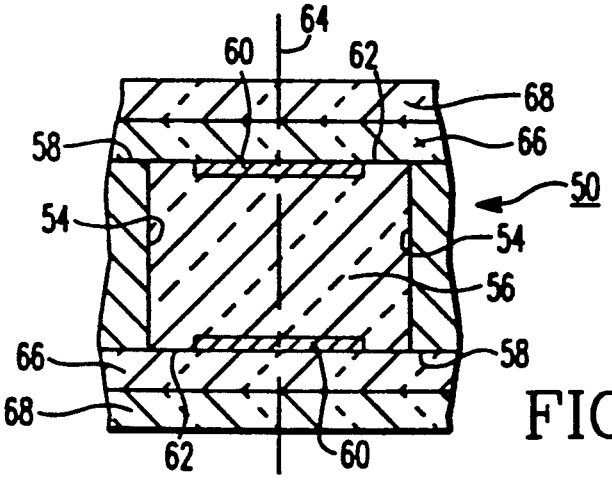
FIG. 5 is a sectional view of a waveguide segment.

A two pole frequency selective surface, filter or radome 50 in accordance with the present invention is illustrated in FIGS. 3-5. The radome 50 comprises a conductive substrate 52. Although other materials may be employed the substrate 52 is preferably in the form of an apertured aluminum plate. Apertures 54 having a diameter D are formed in the plate 52 in a preselected array as illustrated. A moldable dielectric material 56 is located in the apertures 54 and extends between the respective surfaces 58 of the plate 52.

Conductive patches 60 having a diameter d are located on opposite faces 62 of the dielectric 56. The patches 60 are preferably in the form of a copper film lying on the central axis 64 of each aperture 54. A pair of matching dielectric layers 66 and 68 are disposed or laminated atop the opposite faces 58 of the plate 52 for matching the frequency selective surface 50 with free space.

Each aperture 54 forms a waveguide segment 70 in the plate 52. Each waveguide 70 is loaded by the dielectric material 56. The value of the loading is in accordance with the dielectric constant of the material. The waveguides 70 are capacitively loaded by the patches or irises 60 in accordance with the surface area thereof which in general is established by the patch diameter d.

Figure 6:
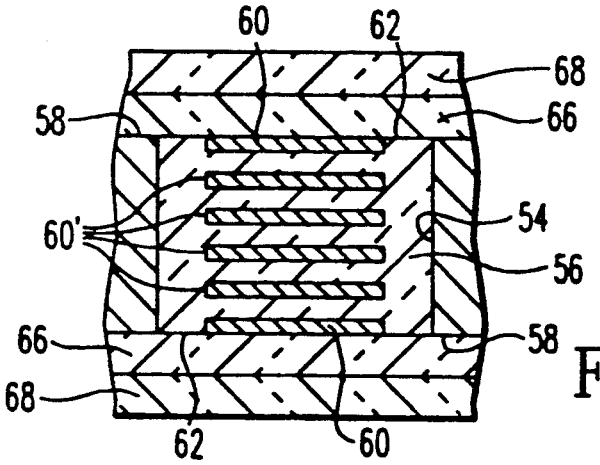
FIG. 6 is a sectional view of the alternative embodiment of the invention.

The arrangements illustrated in FIGS. 4-6 offer significant structural rigidity over prior designs. The aluminum plate 52 and the moldable or pourable dielectric material 56 have significant producibility advantages over prior arrangements. The array of apertures 54 may be very accurately and reproducibly formed by means of a numerically controlled drill (not shown). The dielectric material may be poured or molded into the apertures 54, cured and the excess material removed. The irises 60 may thereafter be deposited by photolithography and excess material removed by etching or the like.

Variable bandwidths may be obtained with the frequency selective surface 50 by altering the dielectric constant of the pourable dielectric 56 used to fill apertures 54 in the aluminum plate 52. The overall design provides a sound, uniform and stable base for the irises 60 and the matching dielectric layers 66 and 68.

Figure 1A:
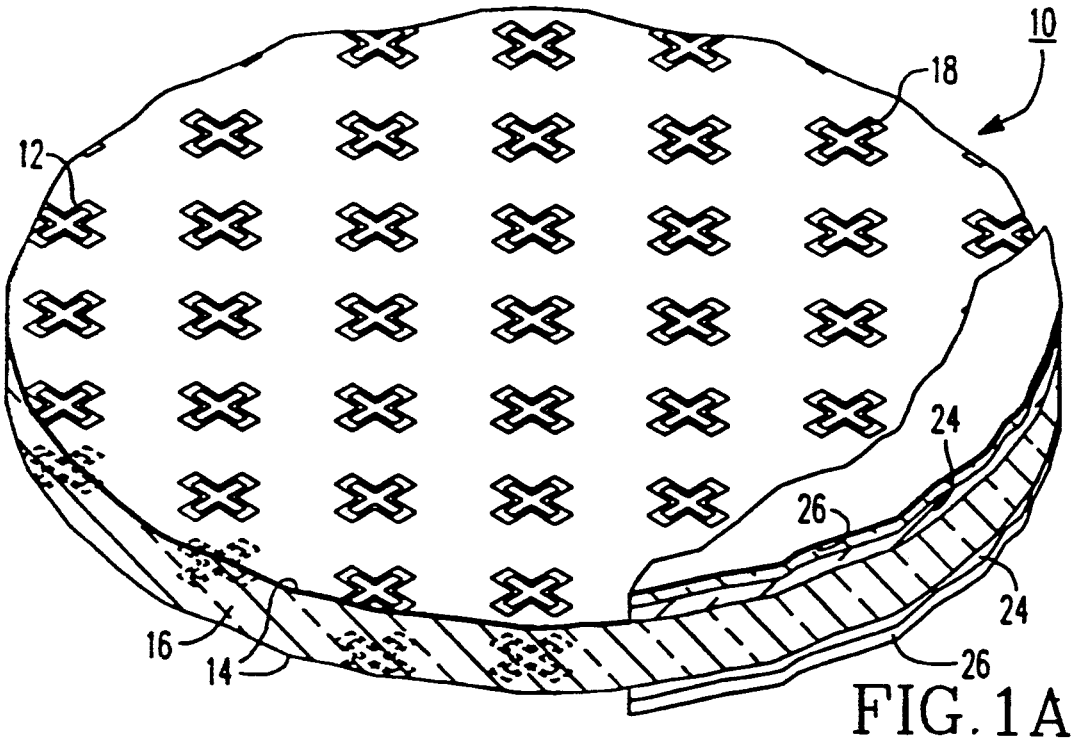
FIG. 1A PRIOR ART
FIGS. 1A-1C represent fragmentary views of a known thin screen frequency selective surface.
Figure 1B:
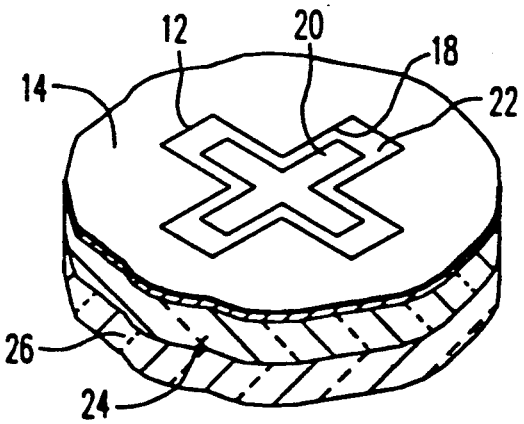
FIG. 1B PRIOR ART
Figure 1C:
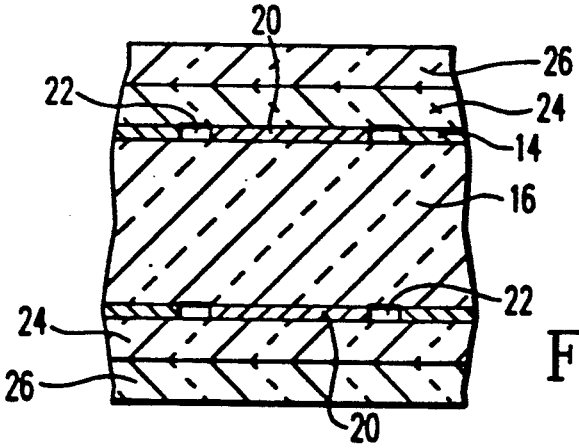
FIG. 1C PRIOR ART
Figure 2A:
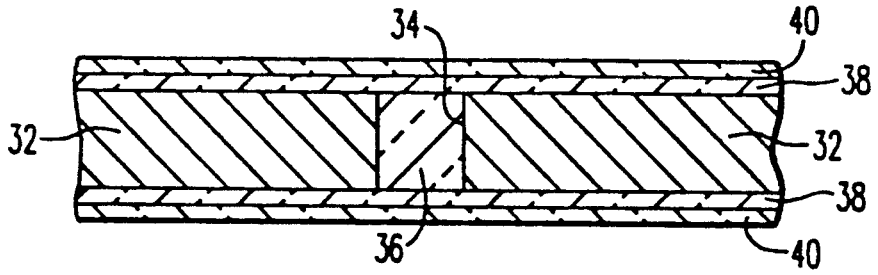
FIG. 2A PRIOR ART
FIGS. 2A-2B represent fragmentary views of a known single pole puck plate.
Figure 2B:
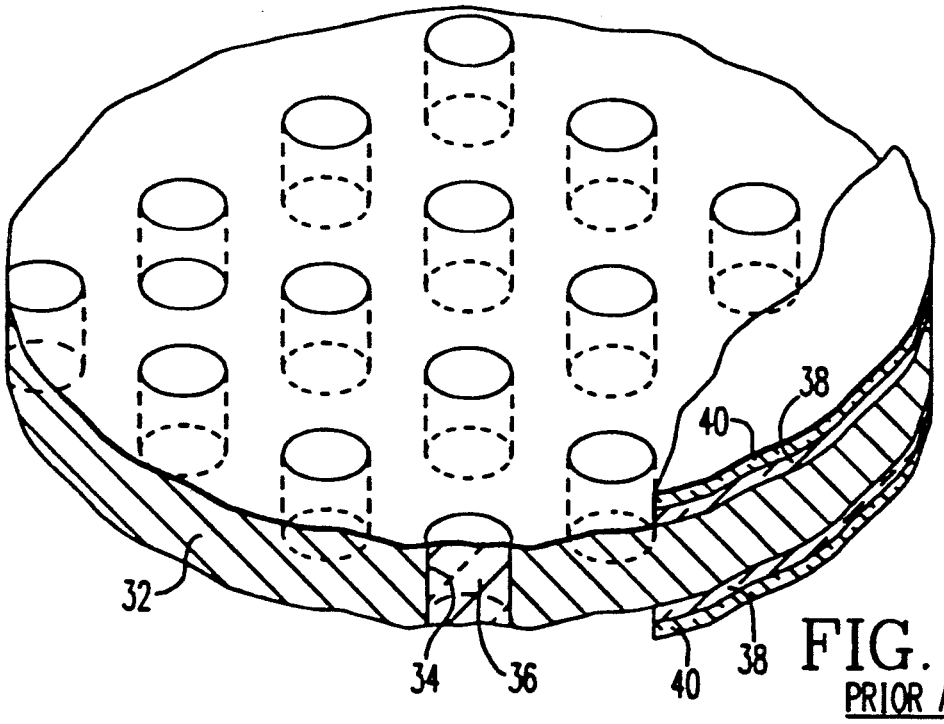
FIG. 2B PRIOR ART
Figure 2C:
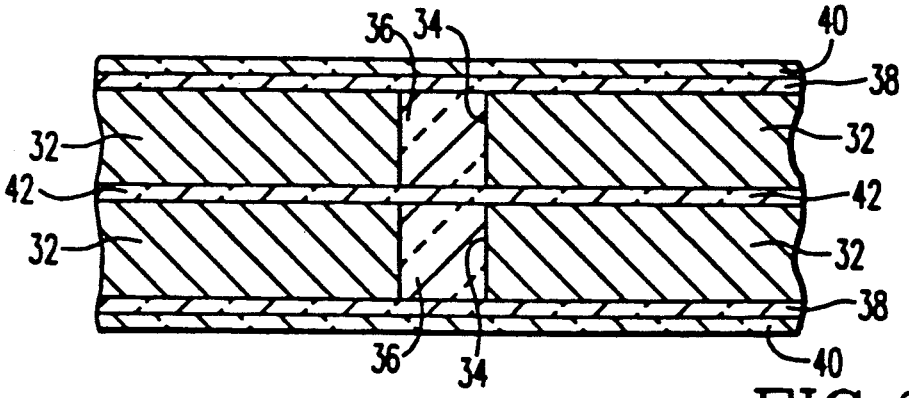
FIG. 2C PRIOR ART
FIG. 2C represents a fragmentary side sectional view of a known two pole puck plate.

The arrangement of the present invention avoids the problems associated with internal trapped surface waves which can occur in the thin screen arrangements (FIGS. 1A-1C) and in the laminated thick screen arrangement illustrated in FIG. 2C.

If desired, a plurality of irises 60, may be laminated or stacked coaxially in the dielectric material 56 within the aperture 54 in order to add more poles to the surface 50. See for example FIG. 6.

As can be appreciated from the above discussion, a number of parameters may effect the frequency selectivity, bandwidth and overall performance of the frequency selective surface 50 described herein. In accordance with the invention, a mathematical analysis employing a spectral moment method solution of the magnetic field integral equations have been used in order to more accurately and predictably calculate performance and to assist in the design process.

Figure 7:
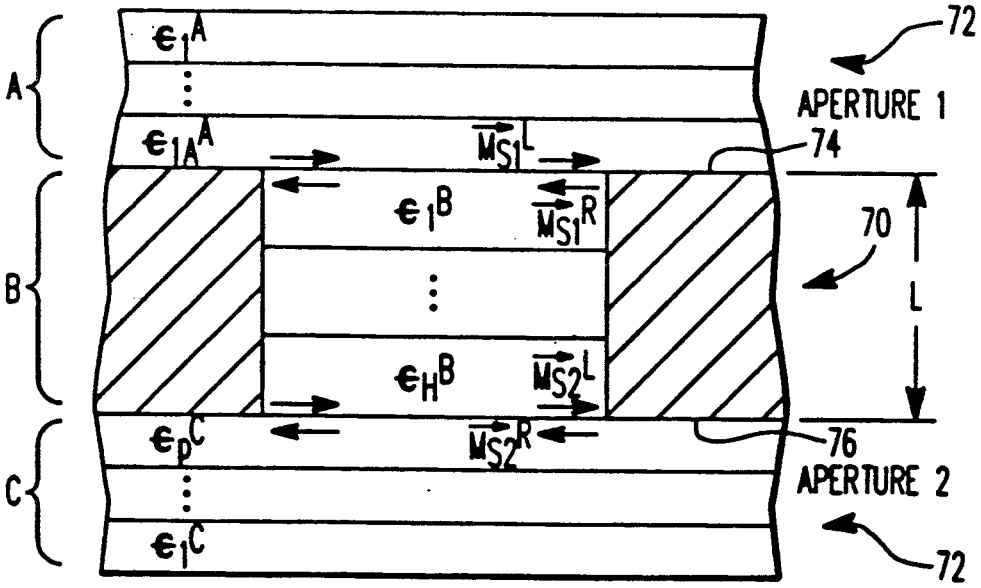
FIG. 7 is a model of exemplary boundaries between free space and a waveguide segment employed in mathematical analysis described herein.

In order to more fully appreciate the mathematical analysis, reference is directed to FIG. 7 which illustrates a model of a waveguide segment 70. Each waveguide segment 70 comprises a finite length L disposed in free space 72 which terminates at respective free space/waveguide boundaries 74 and 76 hereinafter referred to as aperture 1 and aperture 2, respectively. For the purposes of the mathematical analysis, the free space region 72 is divided into regions A and C which represent the regions at opposite ends of the waveguide segment 70 which is defined as region B.

In general in order to analyze a frequency selective medium it is necessary to determine the transmission characteristic of the surface or device. In accordance with the present invention, the spectral moment method for solving the magnetic field integral equation has been employed. The invention requires continuity of tangential electric and magnetic fields E and H across the respective apertures. Reflection and transmission characteristics are calculated by solving for the unknown magnetic currents by means of a matrix representation of the magnetic field continuity equation. The magnetic currents are not real phenomena but are mathematical vector representations of the effect at the boundary or aperture which results in either a transmission or scattering of the incident field. The magnetic current is represented by the vector $M_s$ followed by a number designating the aperture and a superscript representing the side of the aperture, i.e. left or right side at which the current occurs. For example:

$$\text{at aperture 1, } \vec{M}_{s1}{}^{L} = -\vec{M}_{s1}{}^{R} = \vec{M}_{s1} \quad (1)$$

$$\text{At aperture 2, } \vec{M}_{s2L} = -\vec{M}_{s2}{}^{R} = \vec{M}_{s2} \quad (2)$$

Equation 1 represents the magnetic currents which occur at the aperture 1. The magnetic current $\vec{M}_{s1}$ on the left side of the aperture is equal and opposite to the magnetic current on the right side of the aperture. For equation 2 the magnetic current $\vec{M}_{s2}$ is equal to the magnetic current on either side of the aperture which are of opposite signs.

At the boundaries of apertures 1 and 2, the electric field E and the magnetic field H, both vector quantities, are either transmitted or reflected in whole or in part. For purposes of the discussion only the tangential component of the electric and magnetic fields E and H are considered. The other components result from the solution to the equations.

The basic equation used to solve for the transmitted and the reflected fields are as follows:

$$\vec{E}_{1T}{}^{L} = \vec{E}_{1T}{}^{R} \quad (3)$$

$$\vec{H}_{1T}{}^{L} = \vec{H}_{1T}{}^{R} \quad (4)$$

At aperture 1 the tangential component of the electric and magnetic fields are equal to each other on either side of the boundary.

At Aperture 2 the same condition applies, namely:

$$\vec{E}_{2T}{}^{L} = \vec{E}_{2T}{}^{R} \quad (5)$$

$$\vec{H}_{2T}{}^{L} = \vec{H}_{2T}{}^{R} \quad (6)$$

Where:

$\vec{E}_{1T}{}^{L}$ equals tangential electric field on the left side of aperture 1.

$\vec{E}_{1T}{}^{R}$ equals tangential electric field on the right side of aperture 1.

$\vec{H}_{1T}{}^{L}$ equals tangential magnetic field on the left aperture 1.

$\bar{H}_{1T}{}^{R}$ equals tangential magnetic field on the right side of aperture 1.

In equations 5 and 6 the terms are the same except at the fields occur at aperture 2 as designated by the subscript 2.

The paired equations 3 and 4 or 5 and 6 at each boundary mathematically enforce continuity of a tangential electric and magnetic fields E and H, respectively.

To elaborate further, the tangential magnetic fields at aperture 1 are given as follows:

$$\vec{H}^{L}_{1T} = T_{inc}\vec{H}_{inc} \leftarrow \text{incident field} \quad (7)$$

$$- \sum_{m} Y^{MA}_{m} \langle \vec{M}^{L}_{s1}, \vec{h}_{m} \rangle \vec{h}_{m} \frac{T^{L}_{1,1}}{2} \leftarrow \text{field scattered by } \vec{M}^{L}_{s1} \text{ (reflected field)}$$

$$H^{R}_{1T} = - \sum_{n} Y^{1B}_{n} \langle \vec{M}^{L}_{s1}, \vec{h}_{n} \rangle \vec{h}_{n} \frac{T^{R}_{1,1}}{2} \leftarrow \text{field scattered by } \vec{M}^{R}_{s1} \quad (8)$$

$$- \sum_{n} Y^{NB}_{n} \langle \vec{M}^{L}_{s2}, \vec{h}_{n} \rangle \vec{h}_{n} \frac{T_{1,2}}{2} \leftarrow \text{field scattered by } \vec{M}^{L}_{s2}$$

Equating these two fields at aperture 1 yields:

$$T_{inc}\vec{H}_{inc} = \sum_{m} Y^{MA}_{m} \langle \vec{M}^{L}_{s1}, \vec{h}_{m} \rangle \vec{h}_{m} \frac{T^{L}_{1,1}}{2} - \sum_{n} Y^{1B}_{n} \langle \vec{M}^{R}_{s1}, \vec{h}_{n} \rangle \vec{h}_{n} \frac{T^{R}_{1,1}}{2} - \sum_{n} Y^{NB}_{n} \langle \vec{M}^{L}_{s2}, \vec{h}_{n} \rangle \vec{h}_{n} \frac{T_{1,2}}{2} \quad (9)$$

The tangential H fields at aperture 1 are given as:

$$H^{L}_{2T} = - \sum_{n} Y^{1B}_{n} \langle \vec{M}^{R}_{s1}, \vec{h}_{n} \rangle \vec{h}_{n} \frac{T_{2,1}}{2} \leftarrow \text{field scattered by } \vec{M}^{R}_{s1} \quad (10)$$

$$- \sum_{n} Y^{NB}_{n} \langle \vec{M}^{L}_{s2}, \vec{h}_{n} \rangle \vec{h}_{n} \frac{T_{2,2}}{2} \leftarrow \text{field scattered by } \vec{M}^{L}_{s2}$$

$$H^{R}_{2T} = - \sum_{m} Y^{PC}_{m} \langle \vec{M}^{R}_{s2}, \vec{h}_{m} \rangle \vec{h}_{m} \frac{T^{R}_{2,2}}{2} \leftarrow \text{field scattered by } \vec{M}^{R}_{s2} \text{ (transmitted field)} \quad (11)$$

Equating these two fields at aperture 2 yields:

$$O = \sum_{m} Y^{PC}_{m} \langle \vec{M}^{R}_{s2}, \vec{h}_{m} \rangle \vec{h}_{m} \frac{T^{R}_{2,2}}{2} - \sum_{n} Y^{1B}_{n} \langle \vec{M}^{R}_{s1}, \vec{h}_{n} \rangle \vec{h}_{n} \frac{T_{2,1}}{2} - \sum_{n} Y^{NB}_{n} \langle \vec{M}^{L}_{s2}, \vec{h}_{n} \rangle \vec{h}_{n} \frac{T^{L}_{2,1}}{2} \quad (12)$$

Equations (8) and (12), force continuity of the $\bar{E}+\bar{H}$ fields in the aperture, and are used to create a matrix representation of the problem in which $\bar{M}_{s1}$ and $\bar{M}_{s2}$ are solved. Determination of $\bar{M}_{s1}$ and $\bar{M}_{s2}$ yields the reflection and transmission properties desired. Some of the symbol definitions in these equations are:

$T_{inc}$, $T_{1,1}{}^{L}$, $T_{1,1}{}^{R}$, $T_{1,2}$, $T_{2,2}{}^{R}$, $T_{2,1}$, $T_{2,2}{}^{L}$ These terms are called T-factors and they are fully defined by the geometry and properties of the dielectric matching layers and the dielectric filler in the waveguide.

$\bar{h}_s$—free space mode functions (in the common literature).

$\bar{h}_n$—waveguide mode functions (in the common literature).

$\bar{M}_{s1}$—magnetic current in aperture 1 which is represented as a sum of coaxial mode functions (in the common literature).

$\bar{M}_{s2}$—magnetic current in aperture 2 which is represented as a sum of coaxial mode functions (in the common literature).

$\bar{H}_{inc}$—known magnetic field of the incident plane wave.

$Y_m$, $Y_n$—admittance of the dielectric layers.

$\bar{M}_{s1}{}^{L}$ and $\bar{M}_{s2}{}^{L}$ are expanded into coaxial waveguide functions as follows:

$$\vec{M}^{L}_{s1} = \sum_{p=1}^{P} A_p \vec{e}_p{}^{1} \quad (13)$$

$$\vec{M}^{L}_{s2} = \sum_{q=1}^{Q} B_q \vec{e}_q{}^{2} \quad (14)$$

Solving for $A_p$ and $B_q$ yields the transmission and reflection properties of the structure.

Substituting $A_p$ and $B_g$ into the equations (11) and (12) yields for aperture 1.

$$T_{inc} \langle \vec{e}_i{}^{1}, \vec{H}_{inc} \rangle = \sum_{p} A_p \sum_{m} Y^{MA}_{m} \frac{T^{L}_{1,1}}{2} \langle \vec{e}_p{}^{1}, \vec{h}_m \rangle \langle \vec{e}_i{}^{1}, \vec{h}_m \rangle^{*} + \sum_{p} A_p \sum_{n} Y^{1B}_{n} \frac{T^{R}_{1,1}}{2} \langle \vec{e}_p{}^{1}, \vec{h}_n \rangle \langle \vec{e}_i{}^{1}, \vec{h}_n \rangle - \sum_{q} B_q \sum_{n} Y^{NB}_{n} \frac{T_{1,2}}{2} \langle \vec{e}_q{}^{2}, \vec{h}_n \rangle \langle \vec{e}_i{}^{1}, \vec{h}_n \rangle \quad (15)$$

and yields for aperture 2

$$0 = \sum_{p} A_p \sum_{n} Y^{1B}_{n} \frac{T_{2,1}}{2} \langle \vec{e}_p{}^{1}, \vec{h}_n \rangle \langle \vec{e}_j{}^{2}, \vec{h}_n \rangle - \sum_{q} B_q \sum_{m} Y^{PC}_{m} \frac{T^{R}_{2,2}}{2} \langle \vec{e}_q{}^{2}, \vec{h}_m \rangle \langle \vec{e}_j{}^{2}, \vec{h}_m \rangle^{*} - \sum_{q} B_q \sum_{n} Y^{NB}_{m} \frac{T^{L}_{2,2}}{2} \langle \vec{e}_q{}^{2}, \vec{h}_n \rangle \langle \vec{e}_j{}^{2}, \vec{h}_n \rangle \quad (16)$$

Where $e_i{}^{1}$ are coaxial waveguide modes on aperture 1, and $e_q{}^{2}$ are coaxial waveguide modes on aperture 2. The matrix to solve for Ap and Bq is set up as follows:

$$\begin{bmatrix} I_1^{inc} \\ \cdot \\ \cdot \\ \cdot \\ I_p^{inc} \\ 0 \\ 0 \\ 0 \\ 0 \\ 0 \end{bmatrix} \begin{bmatrix} Y^{1,1}_{1,1} & Y^{1,1}_{1,2} & \cdots & Y^{1,1}_{1,P} & Y^{1,2}_{1,1} & Q,2 & Y^{1,2}_{1,2} & \cdots & Y^{1,2}_{1,Q} \\ \cdot & \cdot & \cdot & \cdot & \cdot & \cdot & \cdot & \cdot & \cdot \\ \cdot & \cdot & \cdot & \cdot & \cdot & \cdot & \cdot & \cdot & \cdot \\ \cdot & \cdot & \cdot & \cdot & \cdot & \cdot & \cdot & \cdot & \cdot \\ Y^{1,1}_{p,1} & Y^{1,1}_{p,2} & \cdots & Y^{1,1}_{p,p} & Y^{1,2}_{p,1} & & Y^{1,2}_{p,2} & \cdots & Y^{1,2}_{p,Q} \\ Y^{2,1}_{1,1} & Y^{2,1}_{1,2} & \cdots & Y^{2,1}_{1,p} & Y^{2,2}_{1,1} & & Y^{2,2}_{1,2} & \cdots & Y^{2,2}_{1,Q} \\ \cdot & \cdot & \cdot & \cdot & \cdot & \cdot & \cdot & \cdot & \cdot \\ \cdot & \cdot & \cdot & \cdot & \cdot & \cdot & \cdot & \cdot & \cdot \\ \cdot & \cdot & \cdot & \cdot & \cdot & \cdot & \cdot & \cdot & \cdot \\ Y^{2,1}_{Q,1} & Y^{2,1}_{Q,2} & \cdots & Y^{2,1}_{Q,P} & Y^{2,2}_{Q,1} & & Y^{2,2}_{Q,2} & \cdots & Y^{2,2}_{Q,Q} \end{bmatrix} \begin{bmatrix} A_1 \\ \cdot \\ \cdot \\ \cdot \\ A_p \\ B_1 \\ \cdot \\ \cdot \\ \cdot \\ B_Q \end{bmatrix} \quad (17)$$

-continued $$I_i^{inc} = 2T_{inc} \langle \vec{e}_i^1, \vec{H}_{inc} \rangle^* \quad (18)$$

$$Y_{i,j}^{1,1} = \sum_m Y_m^{MA} T_{1,1}^L \langle \vec{e}_j^1, \vec{h}_m \rangle \langle \vec{e}_i^1, \vec{h}_m \rangle^* + \sum_n Y_n^{1B} T_{1,1}^R \langle \vec{e}_j^1, \vec{h}_m \rangle \langle \vec{e}_i^1, \vec{h}_n \rangle \quad (19)$$

$i = 1$ to $P$
$j = 1$ to $P$ $$Y_{i,j}^{1,2} = \sum_n Y_n^{NB} T_{1,2} \langle \vec{e}_j^2, \vec{h}_n \rangle \langle \vec{e}_i^1, \vec{h}_n \rangle \quad (20)$$

$i = 1$ to $P$
$j = 1$ to $Q$ $$Y_{i,j}^{2,1} = \sum_n Y_n^{1B} T_{2,1} \langle \vec{e}_j^1, \vec{h}_n \rangle \langle \vec{e}_i^2, \vec{h}_n \rangle \quad (21)$$

$i = 1$ to $Q$
$j = 1$ to $P$ $$Y_{i,j}^{2,2} = \sum_m Y_m^{PC} T_{2,2}^R \langle \vec{e}_j^2, \vec{h}_m \rangle \langle \vec{e}_i^2, \vec{h}_m \rangle^* + \sum_n Y_n^{NB} T_{2,2}^L \langle \vec{e}_j^2, \vec{h}_N \rangle \langle \vec{e}_i^2, \vec{h}_n \rangle \quad (22)$$

$i = 1$ to $Q$
$j = 1$ to $Q$

Equations (18)-(22) are used to fill the elements of the matrix (17). One filled, the matrix is inverted to solve for the A's and B's which yield the solution of the problem.

In order to reduce the calculations and to make the mathematical solution practical a computer program was used. The program uses the equations (18)-(22) to fill the matrix (17) and solve it. The majority of the program is used to solve the inner products such as $$\langle e_j^2, h_n \rangle$$

which are integrals over the aperture region. These integrals are tabulated in closed form in the common literature and are not further described herein. In this way, all of the variables which, in a sense, are interdependent upon each other may be input and individually varied in order to establish a desired or calculated output.

The numerical solution to the problem may be affected by various parameters including the grid spacing, the hole diameter, the patch diameter, the dielectric constant of the filler material, and the dielectric constant of the matching materials. In addition the plate thickness, the scan angle, the range of frequencies over which the surface is to be effective and the roll-off at high and low frequencies may be separately chosen as inputs so that the elements of the matrices may be calculated.

The important feature of the analysis is that the continuity of the fields across the boundary is maintained. This is accomplished by equating the magnetic currents on each side of the boundary which results in field expressions which may be equated then solved for fields which are scattered as a result of the magnetic currents which in turn may be use to solve for the transmitted fields.

The geometry for the analysis is for a waveguide segment bounded at its ends by free space. The expressions for free space propagation and waveguide propagation are known. In addition, the mode functions of the electromagnetic propagation are also known. Likewise, the T functions referred to herein and other variables mentioned above are known. The matrix 17 lends itself to computer solution by substitution of functions at the matrix locations and calculation of the matrix after substitution of numerical parameters. Individual expressions, of course, may require separate calculations, for example some equations employ a double integral which is separately calculated and solved in a subroutine, the solution of which is within the capability of those skilled in the art.

Figure 8:
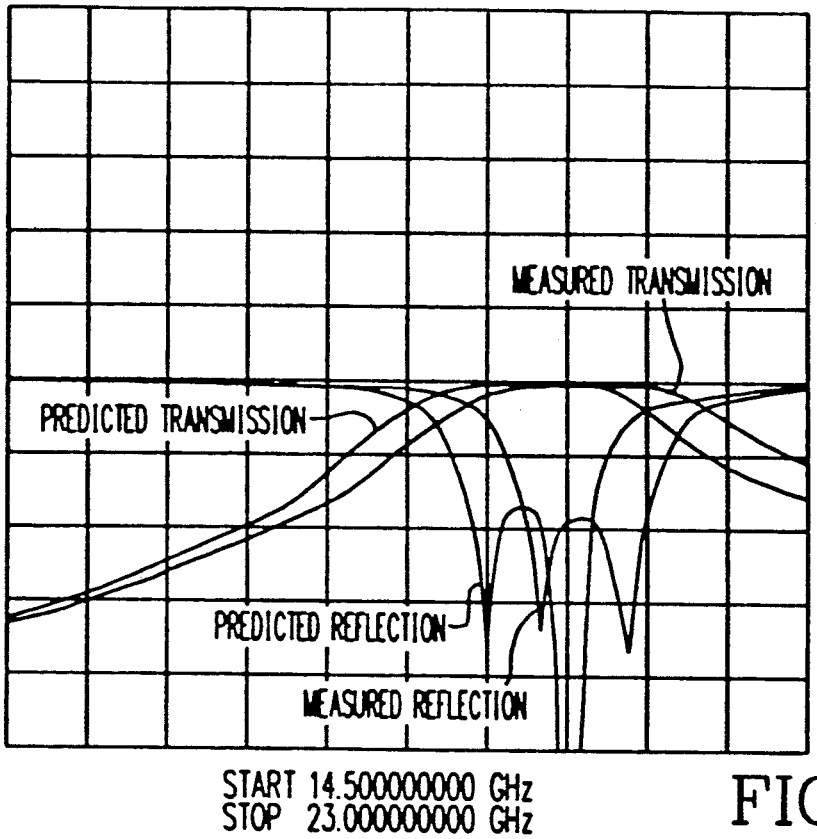
FIG. 8 is a graphical representation illustrating predicted and measured transmission and reflection data for a thick screen artificial puck plate FSS in accordance with the present invention.

FIG. 8 illustrates transmission and reflection versus frequency for an FSS designed to resonate at 20 GHz. The predicted transmission characteristic and measured transmission characteristic closely follow each other. The predicted reflection measurements show a bipolar reflection. While the predicted and measured values do not coincide exactly they are sufficiently close that the performance of an FSS may be determined with great predictability.

The following is a list of parameters defining the exemplary FSS above:

| | |
|---|---|
| Grid configuration | Square |
| Grid spacing (distance between aperture centers) | 0.224" |
| Aperture diameter D | 0.140" |
| Patch diameter d | 0.114" |
| Dielectric 56 ($\epsilon$) (Emmerson & Cummings STYCAST) | 4 |
| Matching dielectric layer 66 ($\epsilon$) (Rodgers Duroid Teflon Film with Copper Thin Film Etched, e.g. 1 mil) | 2.2 u |
| overall thickness | 0.04" |
| Matching dielectric layer 68 ($\epsilon$) (Roacel Foam) thickness | 1.25 |
| Substrate 52 (aluminum) thickness | 0.16" |
| | 0.124 |

Figure 9:
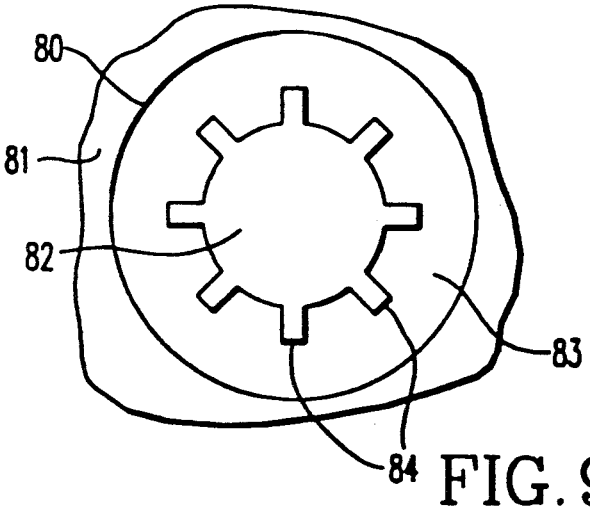
FIG. 9 is an illustration of an alternative embodiment employing a notched iris which has increased capacitance.
Figure 10:
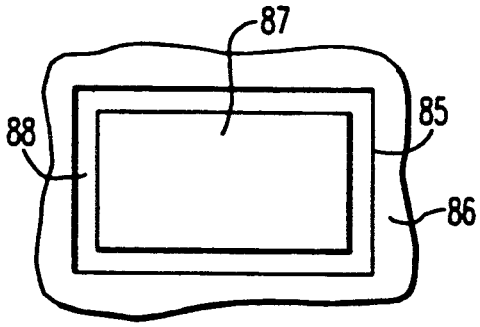
FIG. 10 illustrates an embodiment with a rectangular iris.
Figure 11:
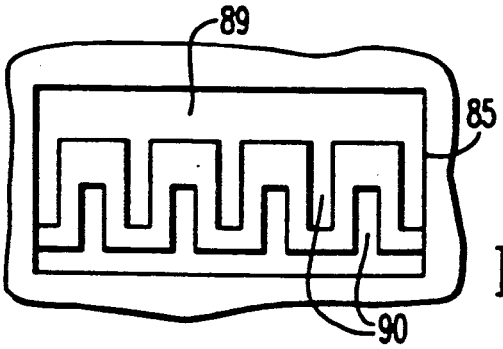
FIG. 11 illustrates an embodiment with an interdigitated linearly polarized iris.

FIGS. 9-11 illustrate alternative embodiments of the invention. In FIG. 9, the circular aperture 80 in substrate 81 has a circular notched iris 82 on the dielectric 83. The iris 82 has fingers 84 extending therefrom which result in increased capacitive loading.

In FIG. 10, a rectangular aperture 85 on the substrate 86 is formed with a rectangular iris 87 on the dielectric 88. The rectangular configuration linearly polarizes the structure.

In FIG. 11, the rectangular aperture 85 is formed with a notched iris 89 having interdigitated fingers 90 which provide high capacitive loading. If desired, the arrangement may be formed with an air dielectric or a moldable dielectric. If an air dielectric is selected, the iris is formed of machined layers of aluminum secured in the aperture 85 by conductive adhesive and separated by an air space. The interdigitated arrangement results in high capacitance.

While there has been described what at present is considered to be the preferred embodiment of the present invention it will be apparent to those skilled in the art that various changes and modifications may be made therein without the departing from the invention and it is intended in the appended claims to cover all such changes and modifications as forward in the true spirit and scope of the invention.

What is claimed is:

1. A two pole frequency selective surface for selectively passing electromagnetic wave energy comprising a conductive substrate having parallel surface portions and a plurality of through holes therein extending between the surfaces, the apertures forming waveguides for electromagnetic energy;

dielectric loading means being moldably formed directly in the apertures and extending between the corresponding opposite surfaces of the substrate for loading the waveguide;

conductive iris means located on each side of the dielectric means and coaxially with the waveguides for capacitively loading each waveguide.

2. The two pole frequency selective surface according to claim 1 wherein the conductive substrate has a selected thickness and the waveguide has a resulting inductance which is a function of substrate thickness.

3. The two pole frequency selective surface according to claim 1 wherein the dielectric loading means has a selected dielectric constant and each waveguide has a selected impedance which is a function of the dielectric loading means.

4. The two pole frequency selective surface according to claim 1 wherein the conductive iris means have a selected area which corresponds to a capacitive value for loading the waveguide in accordance therewith.

5. The two pole frequency selective surface according to claim 1 wherein the iris means comprises circular patches.

6. The two pole frequency selective surface according to claim 5 wherein the circular patches have fingers extending therefrom for increasing the capacitance of the iris means.

7. The two pole frequency selective surface according to claim 1 wherein the iris means comprises rectangular patches.

8. The two pole frequency selective surface according to claim 7 wherein the rectangular patches have interdigitated fingers.

9. A frequency selective surface for selectively passing electromagnetic wave energy in a selected frequency band comprising:

a conductive substrate having a selected thickness between opposite surfaces thereof, and a plurality of sized through apertures therein in a predetermined grid pattern, the apertures forming waveguides for electromagnetic energy;

dielectric loading means having a selected dielectric constant being located in the apertures and extending between the corresponding opposite surfaces of the substrate for loading the waveguide in accordance with the dielectric constant;

conductive iris means having a selected area, one each located in the apertures on each side of the substrate for capacitively loading the waveguide in accordance with the area of the iris; and dielectric matching means on opposite surfaces of the substrate for matching the substrate with external media for efficient electromagnetic wave propagation.

10. The frequency selective surface according to claim 9 wherein the dielectric is a moldable material formed in the apertures and having opposite surface portions conforming to adjacent surface portions of the substrate for supporting the iris means thereon.

11. The frequency selective surface according to claim 10 wherein the iris means have fingers formed therein for increasing capacitance thereof.

12. The frequency selective surface according to claim 9 wherein the dielectric is air and the iris means comprise conductive elements secured in the apertures in conformal relationship with adjacent portions of the substrate and separated by an air gap.

13. The frequency selective surface according to claim 12 wherein the conductive elements have interdigitated fingers for increasing capacitance of the iris means.

14. The frequency selective surface according to claim 9 wherein the iris means comprise conductive elements having fingers for increasing capacitance thereof.

15. The frequency selective surface according to claim 9 wherein the iris means comprises a plurality of coaxial conductors located in spaced relation within each aperture.

16. The frequency selective surface according to claim 15 wherein the iris means are supported by the dielectric.

17. A method for determining parameters of a frequency selective surface formed of a conductive substrate having apertures therein in a predetermined pattern, the apertures forming waveguides for electromagnetic energy, dielectric loading means located in the waveguides and conductive iris means located coaxially on each side of the dielectric means comprising the steps of:

establishing boundary conditions between each of the waveguides and free space in which a magnetic current at each boundary has equal and opposite components on opposite sides of the boundary; equating tangential components of the respective electric and magnetic fields on opposite sides of each boundary for enforcing continuity of electric and magnetic fields in the aperture, constructing a matrix of coefficients representative of T factors defined by geometry and dielectric properties of the waveguide and dielectrics, free space mode functions and waveguide mode functions, and solving the matrix for the coefficients to yield the parameters.

* * * * *